United States Patent [19]

Leister

[11] Patent Number: 4,744,471

[45] Date of Patent: May 17, 1988

[54] TELESCOPING ROD WITH LOCKING DEVICE

[76] Inventor: Judith A. Leister, 4430 Clovermeadow Dr., Meridian, Id. 83642

[21] Appl. No.: 15,048

[22] Filed: Feb. 17, 1987

Related U.S. Application Data

[63] Continuation of Ser. No. 843,156, Mar. 24, 1986, Pat. No. 4,667,352.

[51] Int. Cl.[4] ..... A47H 1/08; E05B 73/00

[52] U.S. Cl. ..... 211/7; 211/105.6; 4/498; 160/330

[58] Field of Search ..... 4/498, 503; 248/354.1, 248/552, 251, 200.1; 211/105.6, 105.5, 123, 7; 160/330

[56] References Cited

U.S. PATENT DOCUMENTS 3,110,506 11/1963 O'Brien ..... 211/105.6

*Primary Examiner*—Henry J. Recla
*Assistant Examiner*—L. J. Peters
*Attorney, Agent, or Firm*—Leslie G. Murray

[57] ABSTRACT

A telescoping, adjustable-length rigid rod for mounting between opposing surfaces, such as the opposing interior walls of a swimming pool, for retaining a cover or the like in position is provided. An elongated tubular structure comprised of a number of telescoping tube sections biased apart by springs forms a rigid rod for compressibly mounting between opposing surfaces. The rod is provided with a locking handle which, in the locked position, expands the telescoping sections lengthwise thus forcing the ends of the rod against the opposing surfaces to prevent removal.

1 Claim, 4 Drawing Sheets

TELESCOPING ROD WITH LOCKING DEVICE

This is a continuation of co-pending application Ser. No. 843,156, filed on Mar. 24, 1986, now U.S. Pat. No. 4,667,352.

BACKGROUND OF THE INVENTION

The present invention relates generally to a rod structure for holding and retaining covers on the surface of swimming pools and, more particularly, to a spring-loaded, telescoping adjustable-length rod having a locking device incorporated therewith.

A great many types and designs of covers for outdoor swimming pools have become commercially available. Early covers were provided to prevent trash and debris from entering the pools and to provide protection from accidental immersion for children and pets when the pools were left unattended. More recently, covers designed to lay or float on the surface of the water have become popular. Floating covers in the form of thermal blankets or pneumatic mattresses insulate a pool from loss of heat, from loss of volatile chemicals such as chlorine, and minimize evaporation of water. Many pool covers are constructed of materials which also provide for pool heating, resulting from solar heating.

Most covers are simple sheets of plastic or other pliant material suspended over or floating on the surface of the water. Variations include mechanical operated covers of numerous kinds using rollers, tracks, hydraulic lifts, etc. to place rigid or flexible membranes above the surface of the water. An example is the pool cover disclosed by U.S. Pat. No. 2,958,872 issued to Fred J. Meyer, Jr., on Nov. 8, 1960. Meyer discloses a swimming pool cover characterized by stringers spaced apart in a desired arrangement and a screen material attached to span the areas between the stringers. The cover is held in place over the pool by spring-loaded hooks which are hooked in eyes anchored in concrete at intervals around the periphery of the pool. U.S. Pat. No. 3,683,428 issued to Lester Morris on Aug. 15, 1972, and U.S. Pat. No. 3,072,920 issued to John I. Yeilott on Jan. 15, 1963 provide examples of pool covers which are designed to float on the surface of the water.

Use of the swimming pool covers described above, while providing adequate protection to the pool, also provide many difficulties. Mechanical operated devices save time, but they are expensive, are quite clumsy and often cannot be installed unless planned for during the original construction. The air-suspended cover disclosed by Meyer gives relatively poor insulation against heat losses, both because a plastic or canvas sheet is not a good insulator and a chimney effect occurs which sweeps moist warm air upward and out of the pool around the edges; radiation losses are also high. The time and energy required to cover and uncover the pool is often excessive. Plastic sheets and solar blankets which float on the surface of the pool are very susceptible to the wind, either being blown in a pile at one edge of the pool or blown completely out of the pool and into the yard. Further, most of the floating covers are not rigid enough to keep heavy or bulky items out of the pools nor do the pool covers described in the prior art off any protection from unauthorized use of the pool.

SUMMARY OF THE INVENTION

It is the principal object of the present invention to provide an adjustable-length locking rod which retains a swimming pool cover floating on the surface of the water which cannot be blown about the pool or out of the pool by the wind.

It is a further object of the present invention to provide a swimming pool cover which can be locked in place to prevent unauthorized use of the swimming pool.

A telescoping rod according to the principles of the present invention provides an elongated tubular structure comprised of a number of telescoping tube sections biased apart by springs or other suitable means and includes a locking mechanism. The telescoping rod is manually compressed together and positioned on top of or attached to a pool cover floating on the surface of a swimming pool between the opposing surfaces of the walls of the swimming pool. Releasing the compressed rod allows it to expand into engagement with the opposing walls of the pool thus holding the rod (or rods) rigidly in place retaining the cover on the surface of the water. A locking mechanism, when in the locked position, expands the rod lengthwise forcing the end of the rod against the opposing sides of the pool to prevent removal of the rod.

BRIEF DESCRIPTION OF THE DRAWINGS

A representative embodiment of the present invention from which the above and other features and objects thereof will be readily understood is described below, having reference to the accompanying drawings in which.

DETAILED DESCRIPTION OF THE PREFERRED EMBODIMENT

Figure 1:
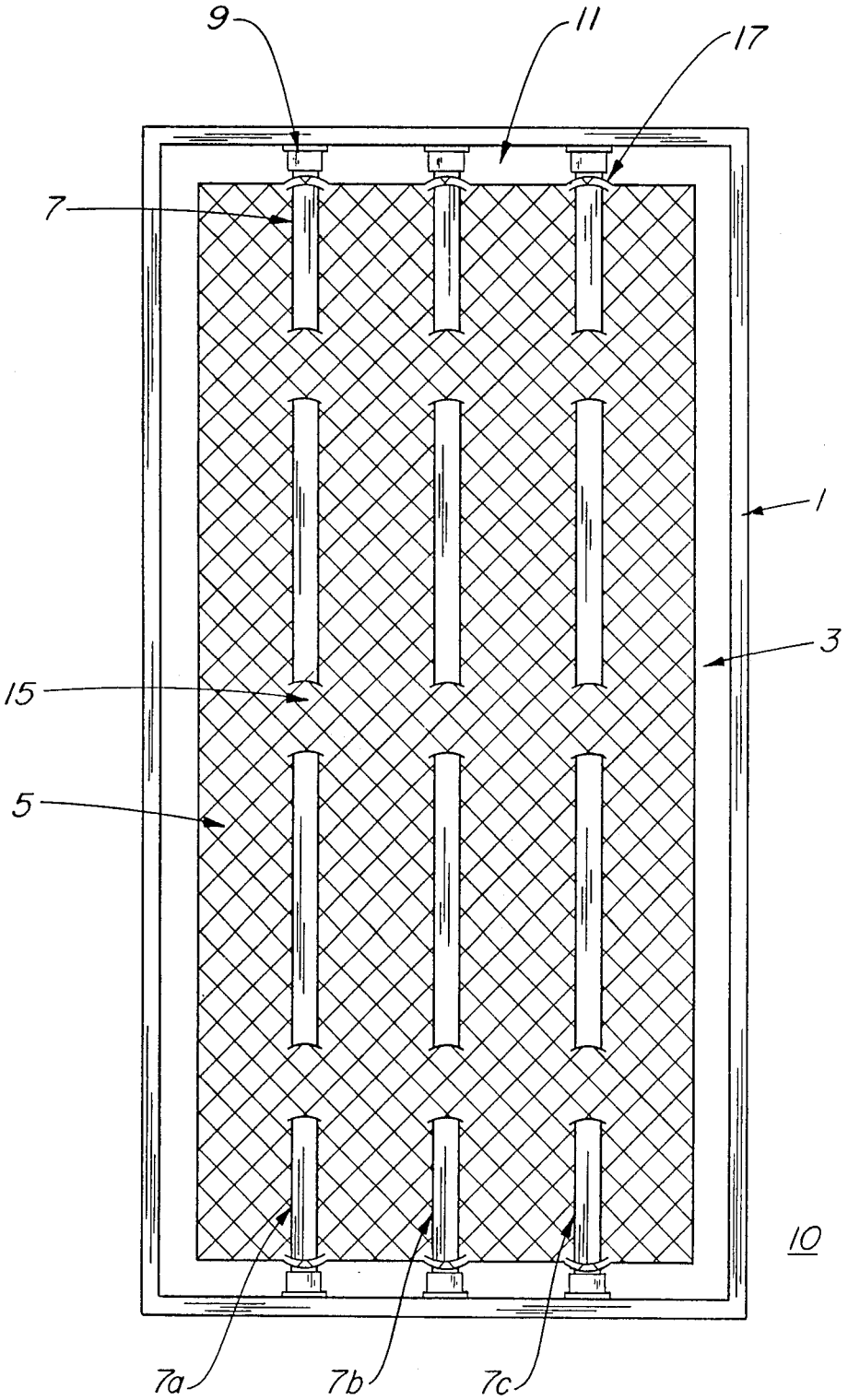
FIG. 1 is a plan view showing a swimming pool cover according to the principles of the present invention in position across a swimming pool.

Referring now to an illustrative-embodiment of the present invention shown in FIG. 1, a plurality of hollow rigid rods *7a, 7b* and *7c* are arranged parallel to each other to span the pool 10 from side to side. The surface of the water 3 is covered by a suitable material 5 which is floated in position. The cover material 5 is attached to each of the rods 7 by a plurality of loops or slits 15 and 17 provided in the cover material 5. The rods 7 are retained in position between opposing walls 11 by the action of spring 15 (as shown in FIG. 2).

The cover material 5 may be of any commercially available material which will float on the surface 3 of the water. Preferrably, the cover 5 will comprise a sheet of plastic material, particularly adapted to resist deterioration due to weather, and an over-layer of thin transparent plastic attached to one face of the sheet, the over-layer being folded at spaced intervals intermediate of its peripheral edge to form a quilted thermal blanket having a plurality of air-filled pockets. A type of material known as "bubble warp" may be used as the cover material. The exposed surface of the plastic sheet may be covered by a reflective surface, and the opposite face of the sheet may be covered by a dark covered material to enhance heat retention and solar heating properties of the cover material 5.

Figure 2:
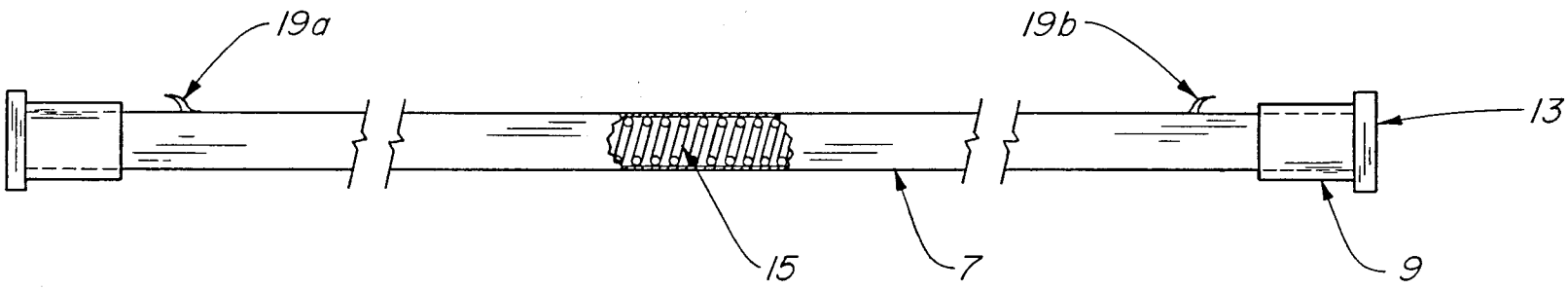
FIG. 2 is a plan view partially in section illustrating the telescoping rod of the cover shown in FIG. 1.

Referring now also to FIG. 2, the rods 7 are comprised of tubular sections constructed of a lightweight metal such as aluminum. The rod 7 can be telescoping in a manner similar to that of an automobile radio antenna, or may be made up of short sections which fit together to form a rod of the desired length. Each end of the rods 7 is covered with a protective boot 9 made of hard rubber or other suitable material. The protective boot 9 will protect the pool walls 11 from any damage which may result from the rods 7 contacting the pool wall 11. The end 13 of the boot 9 is coated with a soft, resilient material having a high coefficient of friction to allow the boot end 13 to grip the wall 11 of the pool without slippage when the boot end 13 is urged against the wall 11. A spring 15 is mounted within the center section of rod 7 in such a manner as to allow the rod 7 to be compressed in length to facilitate inserting the rod 7 between the walls 11 of the pool 10, the restoring force of the spring 15 when compressed urges the rod ends 13 against the wall 11 with sufficient force to retain the rods 7, and hence the blanket 5, in place. With the cover 5 and the rods 7 in position in the pool 10, loops 17 are placed over hooks 19*a* and 19*b* provided on each rod 7 to ensure that the blanket 5 is retained in position covering the entire surface 3 of the pool.

Figure 3A:
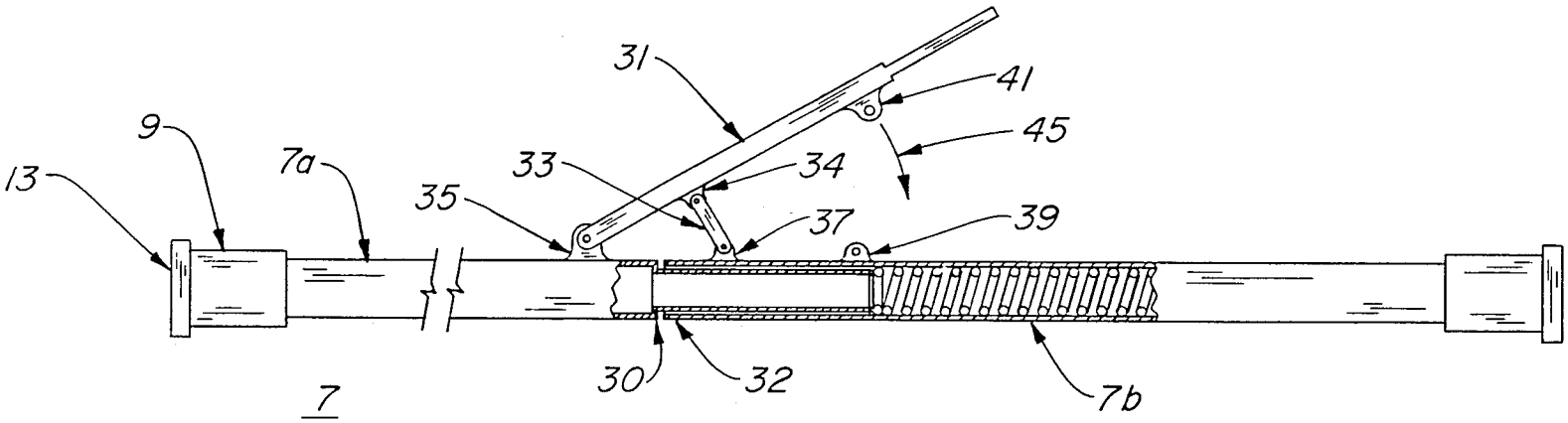
FIG. 3*a* is a plan view partially in section showing a locking handle in the unlocked position.
Figure 3B:
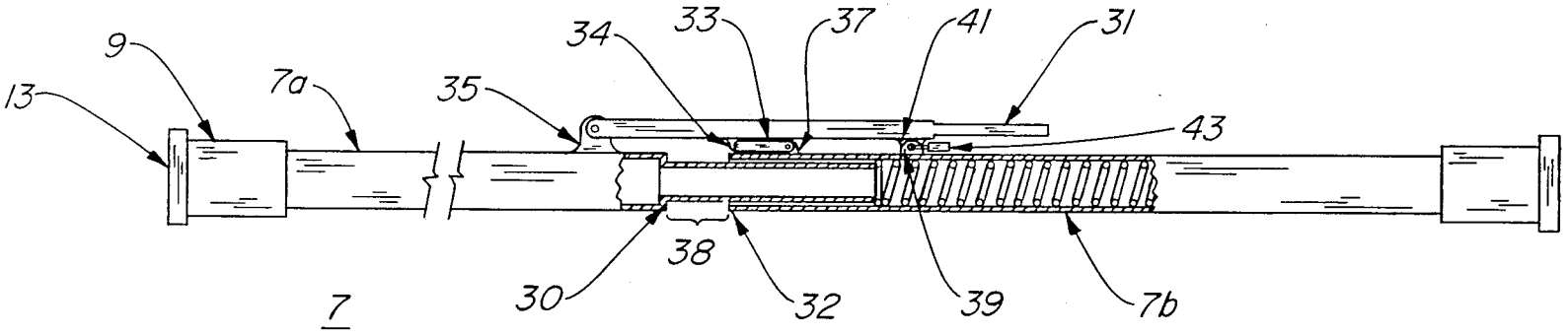
FIG. 3*b* is a plan view partially in section showing the locking handle of FIG. 3*a* in the locked position.

Referring now to FIGS. 3*a* and 3*b*, rod section 7*a* is slidably inserted into rod secions 7*b* with lip 32 of rod section 7*b* abutting shoulder 30 of rod section 7*a*. One end of locking handle 31 is rotatable attached to bracket 35 which is fixedly attached to rod section 7*a* adjacent shoulder 30. Locking handle 31 has two brackets 34 and 41 fixedly attached to it, bracket 34 approximately one-third of the length of locking handle 31 from the attached end and bracket 41 near the free end of the handle 31. Bracket 37 is fixedly attached to rod section 7*b* adjacent lip 32 and opposite bracket 34. Connecting linkage 33 is rotatably attached at opposite ends to brackets 34 and 37. Bracket 39 is fixedly attached to rod section 7*b* in such a position as to be opposite bracket 41 when locking handle 31 is rotated in the direction of arrow 45.

When the pool cover has been installed in the pool, it may be locked into position by rotating locking handle 31 in the direction of arrow 41 thereby forcing rod sections 7*a* and 7*b* apart a short distance 38 and against the walls 11 of the pool (as shown in FIG. 1) with great pressure. When the locking handle 31 is in the locked position (as shown in FIG. 3*b*) holes in brackets 39 and 41 will line up allowing a padlock 43 or other locking device to be inserted thus preventing any movement of the locking handle 31 and removal of the cover from the pool.

While I have shown and described the preferred embodiment of my invention, I wish it to be understood that I do not confine myself to the precise details of construction herein set forth by way of illustration, as it is apparent that many changes and variations may be made therein, by those skilled in the art, without departing from the spirit of the invention or exceeding the scope of the appended claims.

I claim:

1. Apparatus for mounting between opposing surfaces comprising:

an elongated tubular member having two ends and a plurality of telescoping sections, said elongated tubular member being expandable and compressible in length;

spring means disposed within said elongated tubular member for urging the ends of said elongated tubular member into contact with said opposing surfaces;

handle means having two ends, one of said two ends rotatably attached to a first section of said plurality of telescoping sections, said handle means rotatable in the plane of said elongated tubular member, a linkage bar rotatably coupling said handle means to a second section of said plurality of telescoping sections, said second telescoping section adjacent to said first telescoping section, said linkage bar responsive to a rotation of said handle means towards and into contact with said second telescoping section oppositely expanding said first and second telescoping sections thereby urging the ends of said elongated tubular member against said opposing surfaces; and pad lock means detachably coupling the other end of said handle means to said second telescoping section for retaining and securing said handle means in contact with said second telescoping section thereby preventing the removal of said elongated tubular member from between said opposing surfaces.

* * * * *